US012760550B2

(12) United States Patent
Kozal et al.

(10) Patent No.: US 12,760,550 B2
(45) **Date of Patent: *Oct. 13, 2026**

(54) POST ANCHOR

(71) Applicant: UFP Industries, Inc., Grand Rapids, MI (US)

(72) Inventors: John Patrick Kozal, Sparta, MI (US); Daniel James Milanowski, Grand Rapids, MI (US)

(73) Assignee: UFP Industries, Inc., Grand Rapids, MI (US)

( * ) Notice: Subject to any disclaimer, the term of this patent is extended or adjusted under 35 U.S.C. 154(b) by 182 days.

This patent is subject to a terminal disclaimer.

(21) Appl. No.: 18/760,122

(22) Filed: Jul. 1, 2024

(65) Prior Publication Data

US 2024/0352760 A1 Oct. 24, 2024

Related U.S. Application Data

(63) Continuation-in-part of application No. 18/413,827, filed on Jan. 16, 2024, now Pat. No. 12,371,922, which is a continuation of application No. 17/401,499, filed on Aug. 13, 2021, now Pat. No. 11,891,826.

(60) Provisional application No. 63/069,249, filed on Aug. 24, 2020.

(51) Int. Cl.

| | |
|---|---|
| ***E04H 12/22*** | (2006.01) |
| ***E04F 11/18*** | (2006.01) |
| ***E04H 17/22*** | (2006.01) |

(52) U.S. Cl.

CPC ..... *E04H 12/2269* (2013.01); *E04F 11/1812* (2013.01); *E04H 17/22* (2013.01); *E04H 12/2261* (2013.01)

(58) Field of Classification Search

CPC . E04H 12/2269; E04H 17/22; E04H 12/2261; E04F 11/1812

See application file for complete search history.

(56) References Cited

U.S. PATENT DOCUMENTS

| | | | |
|---|---|---|---|
| 3,264,021 | A | 8/1966 | Artman |
| 4,048,776 | A | 9/1977 | Sato |
| 4,125,217 | A | 11/1978 | Sato |
| 5,901,525 | A | 5/1999 | Doeringer |

(Continued)

FOREIGN PATENT DOCUMENTS

| | | | |
|---|---|---|---|
| CN | 208701850 | U | 4/2019 |
| GB | 2469304 | A | 10/2010 |

OTHER PUBLICATIONS https://pylex.com/categorie-produit/patio/, Base 44—Stainless Steel, Product: 13049, 4 pgs Aug. 11, 2021.

*Primary Examiner* — Omar F Hijaz
(74) *Attorney, Agent, or Firm* — McGarry Bair PC

(57) ABSTRACT

A post anchor for a railing system or a fencing system. The post anchor has a base plate and a collar, where the collar extends from the base plate. The collar defines an interior capable of receiving a post. The post anchor can be unitarily formed. A drainage system can be included in the post anchor. An upper surface of the collar can have a recessed portion upon which a railing member can be rested during installation. Alternatively, the collar can be provided with a railing bracket having a pair of juxtaposed legs that define an opening in which a railing member can be received.

18 Claims, 10 Drawing Sheets

(56) References Cited

U.S. PATENT DOCUMENTS

| | | | | |
|---|---|---|---|---|
| 6,336,620 | B1 | 1/2002 | Belli | |
| 6,729,089 | B1 * | 5/2004 | Spragg | E04H 12/2238 248/346.03 |
| D513,536 | S | 1/2006 | Walker | |
| 7,438,214 | B2 | 10/2008 | Riker | |
| 9,004,439 | B2 | 4/2015 | Gross | |
| 9,138,812 | B2 | 9/2015 | Stalemark | |
| 9,476,218 | B2 | 10/2016 | Takahashi | |
| 10,180,011 | B2 * | 1/2019 | White | E04H 12/2261 |
| D884,928 | S | 5/2020 | Gordon | |
| 2007/0187564 | A1 | 8/2007 | McGuire | |
| 2011/0214363 | A1 | 9/2011 | Day | |
| 2012/0131879 | A1 | 5/2012 | Bergman | |
| 2016/0319564 | A1 * | 11/2016 | Lavery | E04H 12/2292 |
| 2022/0064986 | A1 | 3/2022 | Fennema | |

* cited by examiner

POST ANCHOR

CROSS REFERENCE TO RELATED APPLICATIONS

This application is a continuation-in-part of U.S. patent application Ser. No. 18/413,827, filed Jan. 16, 2024, now U.S. Pat. No. 12,371,922, issued Jul. 29, 2025, which, in turn, is a continuation of U.S. patent application Ser. No. 17/401,499, filed Aug. 13, 2021, now U.S. Pat. No. 11,891,826, issued Feb. 6, 2024, which, in turn, claims the benefit of U.S. Provisional Patent Application No. 63/069,249, filed on Aug. 24, 2020, all of which are incorporated herein by reference in their entirety.

BACKGROUND

Fencing or railings are usually constructed from posts and rails attached together using fasteners such as nails or screws. Typically, a number of spaced apart posts are coupled to a surface like a concrete floor or wooden deck. The posts typically extend vertically from the surface and have rails that extend between the posts. The rails are often generally parallel to at least part of the surface to which the posts are mounted. Optionally, pickets can then be nailed, screwed, or welded to the rails such that the pickets are generally perpendicular to top and bottom rails.

BRIEF DESCRIPTION

According to one aspect of the invention, a post anchor comprising a base plate having an upper surface and a lower surface, the base plate defining a set of apertures extending through the base plate from the lower surface to the upper surface, and a collar that extends from the upper surface of the base plate, the collar comprising a set of sides having an interior surface and an exterior surface, each of the set of sides abutting another of the set of sides at corners, wherein at least one of the set of sides includes a set of side wall apertures, and a set of corner members located at the corners, wherein each of the set of corner members includes a corner member aperture that extends from a corner exterior to the interior surface.

According to another aspect of the invention, a post mounting system comprising a post, and a post anchor coupled to the post, the post anchor comprising a base plate having an upper surface and a lower surface, the base plate defining a set of apertures extending through the base plate from the lower surface to the upper surface, and a collar that extends from the upper surface of the base plate, the collar comprising a set of sides having an interior surface and an exterior surface, each of the set of sides abutting another of the set of sides at corners, wherein the interior surface of the set of sides defines an interior that receives at least a portion of the post, a set of side wall apertures extending through at least one side of the set of sides, a first set of fasteners that couple the collar to the post through the side wall apertures, a set of corner members located at the abutting of each of the set of sides, wherein the set of corner members include a set of corner member apertures extending from a corner exterior to the interior surface, and a second set of fasteners that couple the post anchor to the post through the set of corner member apertures.

According to yet another aspect of the invention, a post anchor comprising a base plate having an upper surface and a lower surface, the base plate defining a set of base plate apertures extending through the base plate from the lower surface to the upper surface, and a collar that extends from the upper surface of the base plate, the collar comprising a set of sides extending from the upper surface and having an interior surface and an exterior surface, wherein each of the set of sides abut at corners to define an interior cavity that receives at least a portion of the post, a set of side wall apertures extending through at least one side of the set of sides, a first set of fasteners that couple the collar to the post through the set of side wall apertures, a set of corner members located at the corners, wherein each of the set of corner members include a set of corner member apertures extending from a corner exterior to the interior surface, a second set of fasteners that pass through the set of corner member apertures and couple the post anchor to the post, and top protrusions extending from the set of sides at or adjacent the corners, and at least one bracket is positioned between at least two of the top protrusions.

In another aspect of the invention, a post anchor comprising a base plate having an upper surface and a lower surface, the base plate defining a set of apertures extending through the base plate from the lower surface to the upper surface; and a collar that extends from the upper surface of the base plate, the collar comprising a set of sides having an interior surface and an exterior surface, each of the set of sides abutting another of the set of sides at corners, wherein at least one of the set of sides includes a set of side wall apertures; and a set of corner members located at the corners, wherein each of the set of corner members includes a corner member aperture that extends from a corner exterior to the interior surface; and wherein an upper surface of at least one of the set of sides comprises a recessed portion extending downwardly from the upper surface thereof and between respective corner members thereof to define a resting surface capable of receiving a portion of a railing; whereby the portion of the railing can be rested within the recessed portion of the upper surface of the at least one set of sides to facilitate mounting of the railing to a post located within the collar of the post anchor.

Various embodiments of the invention are also contemplated without departing from the scope of the invention. The upper surface can be provided on at least two of the set of sides. The at least two of the set of sides can comprise at least two of a pair of adjacent sides. The at least two of the set of sides can comprise at least two of a pair of opposite sides. The post anchor can comprise a polyamide or nylon and fiberglass. The post anchor can comprise nylon. The base plate and the collar can be unitarily formed by injection molding. The recessed portion can comprise a linear portion juxtaposed between shoulders integrally formed with the respective one of the set of sides. The linear portion of the recessed portion can be configured with a minimum width of at least 1.5 inches to receive a standard portion of a railing.

In yet other aspects of the invention, a post mounting system comprising a post; and a post anchor coupled to the post, the post anchor comprising a base plate having an upper surface and a lower surface, the base plate defining a set of apertures extending through the base plate from the lower surface to the upper surface; and a collar that extends from the upper surface of the base plate, the collar comprising a set of sides having an interior surface and an exterior surface, each of the set of sides abutting another of the set of sides at corners, wherein the interior surface of the set of sides defines an interior that receives at least a portion of the post; a set of side wall apertures extending through at least one side of the set of sides; a first set of fasteners that couple the collar to the post through the set of side wall apertures; a set of corner members located at the abutting of each of the set of sides, wherein the set of corner members include a set of corner member apertures extending from a corner exterior to the interior surface; a second set of fasteners that couple the post anchor to the post through the set of corner member apertures; and wherein an upper surface of at least one of the set of sides comprises a recessed portion extending downwardly from the upper surface thereof and between respective corner members thereof to define a resting surface capable of receiving a portion of a railing; whereby the portion of the railing can be rested within the recessed portion of the upper surface of the at least one set of sides to facilitate mounting of the railing to a post located within the collar of the post anchor.

In various embodiments, the upper surface can be provided on at least two of the set of sides. The at least two of the set of sides can comprise at least two of a pair of adjacent sides. The at least two of the set of sides can comprise at least two of a pair of opposite sides. The post anchor can comprise a polyamide or nylon and fiberglass. The recessed portion can comprise a linear portion juxtaposed between shoulders integrally formed with the respective one of the set of sides. The linear portion of the recessed portion can be configured with a minimum width of at least 1.5 inches to receive a standard portion of a railing.

In another aspect of the invention a post anchor can comprise a base plate having an upper surface and a lower surface, the base plate defining a set of apertures extending through the base plate from the lower surface to the upper surface; and a collar that extends from the upper surface of the base plate, the collar comprising: a set of sides having an interior surface and an exterior surface, each of the set of sides abutting another of the set of sides at corners, wherein at least one of the set of sides includes a set of side wall apertures; and a set of corner members located at the corners, wherein each of the set of corner members includes a corner member aperture that extends from a corner exterior to the interior surface; wherein an upper surface of at least one of the set of sides comprises a railing bracket defined by a pair of sides extending upwardly from the collar and juxtaposed from one another to define an opening therebetween capable of receiving a portion of a railing; and whereby the portion of the railing can be located within the opening of the railing bracket to facilitate mounting of the railing to at least one of a post located within the collar of the post anchor or the post anchor itself.

In yet another aspect of the invention, a post mounting system can comprise a post; and a post anchor coupled to the post, the post anchor comprising: a base plate having an upper surface and a lower surface, the base plate defining a set of apertures extending through the base plate from the lower surface to the upper surface; and a collar that extends from the upper surface of the base plate, the collar comprising: a set of sides having an interior surface and an exterior surface, each of the set of sides abutting another of the set of sides at corners, wherein the interior surface of the set of sides defines an interior that receives at least a portion of the post; a set of side wall apertures extending through at least one side of the set of sides; a first set of fasteners that couple the collar to the post through the set of side wall apertures; a set of corner members located at the abutting of each of the set of sides, wherein the set of corner members include a set of corner member apertures extending from a corner exterior to the interior surface; and a second set of fasteners that couple the post anchor to the post through the set of corner member apertures; wherein an upper surface of at least one of the set of sides comprises a railing bracket defined by a pair of sides extending upwardly from the collar and juxtaposed from one another to define an opening therebetween capable of receiving a portion of a railing; and whereby the portion of the railing can be located within the opening of the railing bracket to facilitate mounting of the railing to at least one of a post located within the collar of the post anchor or the post anchor itself.

In various embodiments related to these aspects, the invention can also comprise various alternatives. The legs on the railing bracket can be provided with at least two apertures for receipt of fasteners therein. The at least two apertures on the legs of the railing bracket can have non-parallel arrangement for toenailing a railing member to the post anchor. The railing bracket can be provided on at least two sides of the post anchor. The railing bracket can be provided on a pair of opposite sides of the post anchor. The railing bracket can be provided on a pair of adjacent sides of the post anchor. The railing bracket can be provided on at least three sides of the post anchor. The railing bracket can be provided on all but one side of the post anchor. The railing bracket can be provided on all sides of the post anchor.

DETAILED DESCRIPTION

Figure 1:
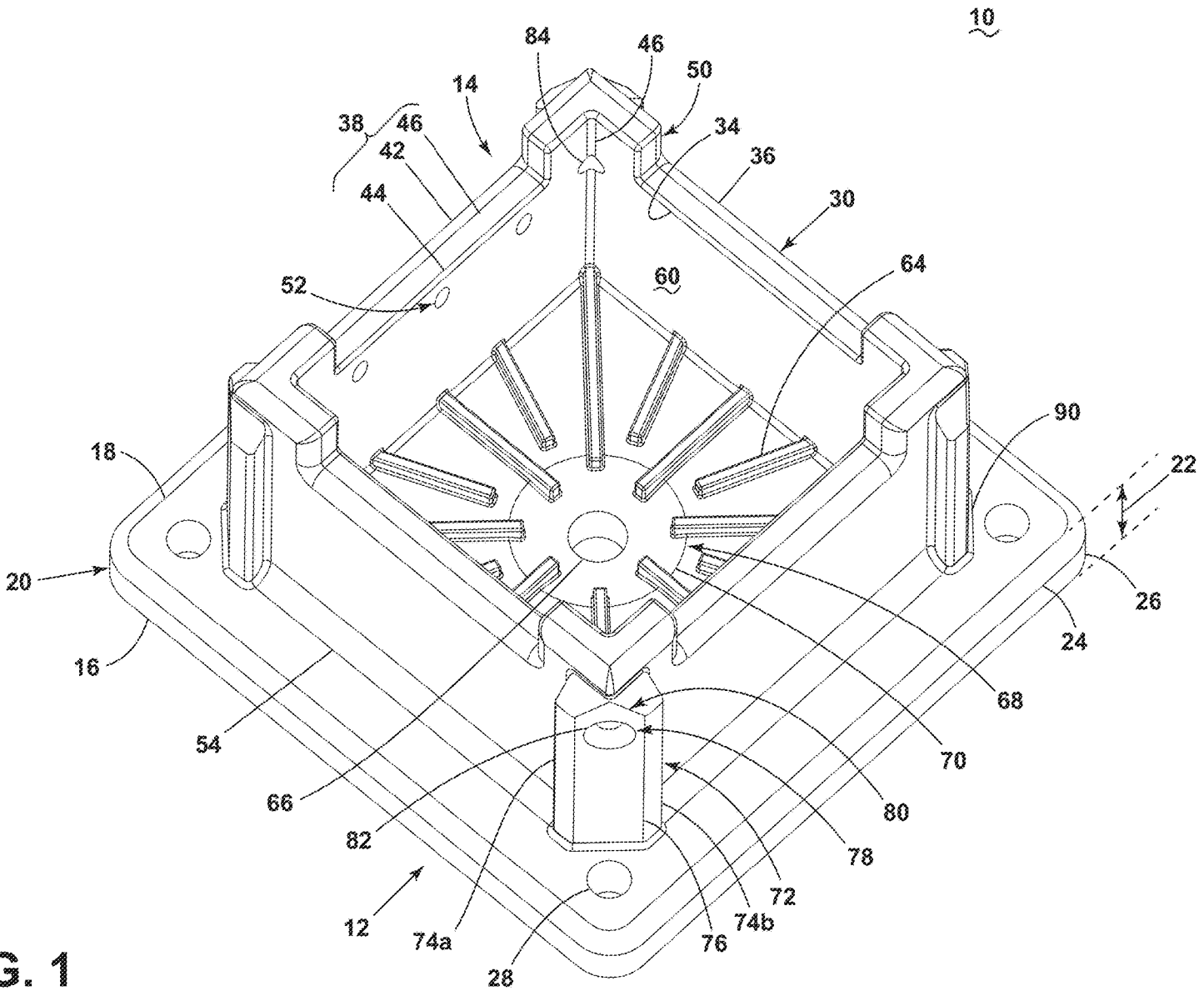
FIG. 1 is a perspective view of a post anchor according to aspects of the present disclosure.

A post anchor can be utilized to secure a post to a surface. A fence or railing installation is often dependent on the structural integrity of the post attachment. Aspects of the present disclosure relate to a post anchor that receives a post and attaches to a surface in such a manner that the installation passes the International Building Code (IBC) or the International Residential Code (IRC) per structural and deflection requirements. Such surfaces can be, but are not limited to, concrete flooring, wood decking, composite decking, stone flooring, porcelain tiles or any other kind of indoor and outdoor flooring, decking, patio, platform, or slab.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, secured, fastened, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purpose of illustration only and the dimensions, positions, order and relative sizes reflected in the drawings attached hereto can vary.

While "a set of" or "a plurality of" various elements will be described, it will be understood that "a set" or "a plurality" can include any number of the respective elements, including only one element.

As used herein, the term "generally perpendicular" defines an angle between two objects, elements of objects, or linear extensions of elements or objects that defines an angle approximately between 80 degrees and 100 degrees between the respective two objects. Similarly, the term "generally parallel" describes two objects, elements of objects, or linear extensions of the elements or objects forming an angle between the respective objects, elements of objects, or linear extensions of the elements or objects, with the defined angle having a measure that is at or between 0 and 15 degrees between the respective objects.

FIG. 1 illustrates a perspective view of a bracket or post anchor 10. It will be understood that the post anchor 10 can be formed in any suitable fashion. The post anchor 10 can be a unitary monolithic component. That is, the post anchor 10 can be, for example, formed by injection molding, cast, or additively manufactured. The term "additively manufactured" can include, but is not limited to, powder bed fusion, binder jetting, directed energy deposition, material extrusion, material jetting, sheet lamination, or vat polymerization.

The post anchor 10 can be created with multiple material types such as, but not limited to, cast metals or injection molded plastic. Optionally, fiberglass or other additives can be combined with the plastic. The mixture of plastic to fiberglass or other additives can be of any combination as needed to pass building code requirements such as but limiting to IBC or IRC. For example, the mixture can include one or more polyamides and fiberglass. The polyamides can be PA 66 nylon or PA 6 nylon plastic. It is contemplated that the loading of glass fiber in the material used to form the post anchor 10 can be between 0%-70%. For example, if the loading of glass fiber is 30%, then the post anchor 10 comprises 30% glass fibers and 70% other material. By way of further example, the 70% of other material can include 65% PA 6 nylon and 5% other additives. The combination of fiberglass reinforced plastic is advantageous because it can increase flexural strength (also known as modulus of rupture or MOR) and flexural modulus (also known as modulus of elasticity or MOE) within the post anchor 10. The combination of plastic and fiberglass also can withstand elevated temperatures and extended ultra-violet (UV) exposure. It is contemplated that the ratio of plastic to fiberglass and the percent of fiber loading can vary based on the desired length of the post to be mounted to the post anchor 10. It is further contemplated that the post anchor 10 can include longer glass fibers, carbon fiber, or other fillers as needed to strengthen the post anchor 10. The mixture of the post anchor 10 can depend on the surface to which it is mounted, the application or length of the post mounted to the post anchor, or to meet building code requirements in different regions.

The post anchor 10 can include a base or base plate 12 and a collar 14, extending from the base plate 12. The base plate 12 includes a lower surface 16 and an upper surface 18. A side surface 20 connects the between the lower surface 16 and the upper surface 18 to define the base plate 12.

A base thickness 22 can be measured from the upper surface 18 to the lower surface 16. The base thickness 22 of the base plate 12 can be of any thickness, which is needed to pass building code requirements such as IBC or IRC. While any thickness required to meet building code is contemplated, the base thickness 22 can be approximately ⅝ of an inch (approximately 16 millimeters).

As illustrated, by way of non-limiting example, the side surface 20 includes a rounded or contoured portion 24 and a linear or flat portion 26. However, it is contemplated that the side surface 20 can include any number of linear or flat portions or rounded or contoured portions. While any radius of curvature is contemplated, the contoured portion 24 of the side surface 20 can have a radius of curvature less than or equal to half of the base thickness 22. It is further contemplated that the contoured portion 24 can be a convex curve, concave curve, or any combination therein.

Base mounting holes or a set of base plate apertures 28 can extend between the upper surface 18 and the lower surface 16 of the base plate 12. While illustrated as having four base plate apertures 28, any number of base apertures are contemplated. The base plate apertures 28 can be of uniform cross section or diameter as the base plate apertures 28 extend from the upper surface 18 to the lower surface 16. However, it is contemplated that the cross section or diameter can increase, decrease, or change shape as the base plate apertures 28 extend from the upper surface 18 to the lower surface 16. It is further contemplated that the base plate apertures 28 can be threaded or otherwise formed to receive or secure one or more portions of a fastener such as, but not limited to, a screw, bolt, washer, gasket, grommet, nut, nail, rivet, or anchor.

A set of sides 30 of the collar 14 can extend generally perpendicular to the base plate 12, however other angles are contemplated. The collar 14 and the base plate 12 can be unitarily formed to define the post anchor 10. Alternatively, the collar 14 can be welded or otherwise fastened to the base plate 12.

While illustrated as four identical or equal sides 30, any number of sides 30 or variation in dimensions of the sides 30 of the collar 14 are contemplated. Each of the sides 30 include an interior surface 34 and an exterior surface 36. A top surface 38 connects each interior surface 34 to the corresponding exterior surface 36.

As illustrated, by way of non-limiting example, the top surface 38 includes an inner shoulder 40, an outer shoulder 42 and a linear or flat portion 44. However, it is contemplated that the top surface 38 can include any number of linear or flat portions or rounded or contoured shoulder portions. It is further contemplated that the contoured shoulder portions can be a convex curve, a concave curve, linear or flat, or any combination therein.

Each of the set of sides 30 abut another of the set of sides 30 at corners 46. That is, the intersection or abutting of the sides 30 can define the corners 46. The sides 30 can include top protrusions 50 extending away from the base plate 12. The sides 30 can abut such that the top protrusions 50 of each of the sides 30 also abut. The top protrusions 50 of the sides 30 increases height of the sides 30 at the corners 46. That is, the top protrusions 50 increase the distance the sides 30 extend away from the base plate 12 at and near the corners 46.

A benefit of the inclusion of the top protrusions 50 is to make the sides 30 at the corners 46 higher or taller, relative to a direction moving away from the base plate 12. The increase in height adds structural integrity to strengthen the corners 46.

Side holes or a set of side wall apertures 52 can extend between the exterior surface 36 and the interior surface 34 of at least one of the sides 30 of the collar 14. While illustrated as having a set of three side wall apertures 52 in one the sides 30, four side wall apertures 52 are contemplated. It is further contemplated that any number of side wall apertures 52 can be located at one or more of the sides 30. While illustrated as being aligned, the set of side wall apertures 52 can be located in any portion of one or more sides 30. That is, the set of side wall apertures 52 do not have to be equally spaced from the base plate 12.

A fillet 54 can be located at the intersection of the upper surface 18 of the base plate 12 and the exterior surface 36 of the sides 30 of the collar 14. The radius or radius of curvature between the exterior surface 36 of the collar 14 and the upper surface 18 of the base plate 12 acts as structural gusset. Stress concentration is a problem of load-bearing mechanical parts, which can be reduced by the inclusion of the fillet 54 on points and lines of expected high stress including at the juncture of the sides 30 of the collar 14 and the base plate 12. The fillets 54 distribute stress over a broader area and effectively make the post anchor 10 more durable and capable of bearing larger loads.

The fillets 54 can minimize potential for stress risers or concentrated tensions at sharp corners dependent on the size of the fillets 54. While any radius of curvature is contemplated, the fillets 54 can have a radius of curvature less than or equal to half of the base thickness 22. Additionally, if the post anchor 10 is created with injected molding, the fillets 54 can allow for easier flow of the casting material during the molding process to reduce molded-in stresses.

An interior cavity or receiver 60 capable of receiving a post 100 (see FIG. 2) can be defined by the interior surfaces 34 of the sides 30 and at least a portion of the upper surface 18 of the base plate 12. Ribs 64 can extend away from the at least a portion of the upper surface 18 into the receiver 60 from the sides 30.

A drain or an opening 66 can be located at the center of the receiver 60 that extends from the lower surface 16 to the upper surface 18 of the base plate 12. The opening 66, while illustrated as circular, can be any shape such as, but not limited to, oval, rectangular, diamond, or hexagon. It is further contemplated that the opening 66 can have a cross section of any regular or irregular polygon and can include or be combined with curved shapes. While illustrated as a single opening 66, any number of drains or openings in the upper surface 18 of the base plate 12 are contemplated.

A funnel 68 can be defined by a portion of the upper surface 18 of the base plate 12 that circumscribes the opening 66. The funnel 68 can have a decreasing thickness between the upper surface 18 and the lower surface 16, as measured from a radially outer edge 70 of the funnel 68 to or toward the opening 66. The decreasing thickness defines a slope allowing fluid that enters the receiver 60 to be drained out of the receiver 60 via the opening 66. By way of non-limiting example, the decrease in thickness from the radially outer edge 70 of the funnel 68 to the opening 66 can be 10% or less of the base thickness 22. It is contemplated that the ribbing 64 or the at least a portion of the upper surface 18 of the base plate 12 can also change thicknesses at any point in the receiver 60.

A set of corner members 72 can be located at each of the corners 46. The corner members 72 extend from the upper surface 18 of the base plate 12 and are formed with or coupled to the exterior surface 36 of the sides 30 at each of the corners 46. That is, the corner members 72 provide additional material that surrounds the outside of each of the corners 46 to provide structural support at each of the corners 46.

Each of the corner members 72 can include, by way of non-limiting example, a set of flared protrusions 74*a*, 74*b*. While illustrated as two flared protrusions 74*a*, 74*b*, the set of flared protrusions 74*a*, 74*b* can include any number of flared protrusions. Each flared protrusion 74*a*, 74*b* of the set of flared protrusions 74*a*, 74*b* can have a horizonal cross section that has the shape of a truncated trapezoidal prism with rounded edges.

The set of flared protrusions 74*a*, 74*b* can extend away from the base plate 12 a distance that is shorter than the distance extended by the portions of the sides 30 having the top protrusion 50.

The set of flared protrusions 74*a*, 74*b* can add additional strengthening support to the corners 46 because the set of flared protrusions 74*a*, 74*b* add to the overall thickness of each corner 46.

At least one flat face 76 can partially define the corner members 72. The flat face 76 can extend from the base plate 12 adjacent the intersection of the sides 30 at each of the corners 46. As illustrated by way of non-limiting example, the flat face 76 can be located between two members of the set flared protrusions 74*a*, 74*b*. The flat face 76 can have a similar height as the set of flared protrusions 74*a*, 74*b*. Optionally, the flat face 76 can define one or more portions of the set of flared protrusions 74*a*, 74*b*. That is, it will be understood that the flat face 76 need not be a separate feature from the set of flared protrusions 74*a*, 74*b* and that instead the flat face 76 can be formed from two adjoining flared protrusions 74*a*, 74*b* abutting one another at the corner 46.

A set of corner member apertures 78 can create a passage or opening that extends from a corner exterior 80 or the flat face 76 to the interior surface 34 of the sides 30. That is, each of the set of corner members 72 includes at least one corner member aperture 78 that extends from the corner exterior 80 to the interior surface 34. As illustrated, by way of non-limiting example, the corner member apertures 78 can have a corner inlet 82 located at the corner exterior 80 or the flat face 76 of the corner member 72 and a corner outlet 84 located at the interior surface 34 of one or more of the corners 46. While illustrated as each corner member 72 having one of the corner member apertures 78, the corner members 72 can include any number of corner apertures. The corner member apertures 78 can be of uniform cross section or diameter as the corner member apertures 78 extend from the corner exterior 80 or the flat face 76 to the interior surface 34. Alternatively, it is contemplated that the cross section or diameter can increase, decrease, or change shape as the corner member apertures 78 extend from the corner exterior 80 or the flat face 76 to the interior surface 34. It is further contemplated that the corner member apertures 78 can be an angled passage. That is, the corner inlet 82 and the corner outlet 84 are not aligned as compared to the lower surface 16 of the base plate 12. The corner member apertures 78 can be threaded or otherwise formed to receive or secure one or more portions of a fastener or one or more fasteners such as, but not limited to, a screw, bolt, washer, gasket, grommet, nut, nail, rivet, or anchor.

Corner fillets 90 can be located at the intersection of the upper surface 18 of the base plate 12 and the corner member 72 or corner exterior 80. The corner fillets 90 provide structural support and can improve manufacturing. The radius or radius of curvature between the corner exterior 80 and the upper surface 18 of the base plate 12 acts as structural gusset. Stress concentration is a problem of load-bearing mechanical parts, which can be reduced by the inclusion of the corner fillets 90 on points and lines of expected high stress including at the juncture of the corner members 72 of the collar 14 and the base plate 12. The corner fillets 90 distribute stress over a broader area and effectively make the post anchor 10 more durable and capable of bearing larger loads.

The corner fillets 90 can minimize potential for stress risers or concentrated tensions at sharp corners dependent on the size of the corner fillets 90. While any radius of curvature is contemplated, the corner fillets 90 can have a radius of curvature greater than or equal to the radius of curvature of the fillets 54. Alternatively, the radius of curvature of the corner fillets 90 can be less than the radius of curvature of the fillets 54. Additionally, if the post anchor 10 is created with injected molding, the corner fillets 90 can allow for easier flow of the casting material during the molding process to reduce molded-in stresses.

Figure 2:
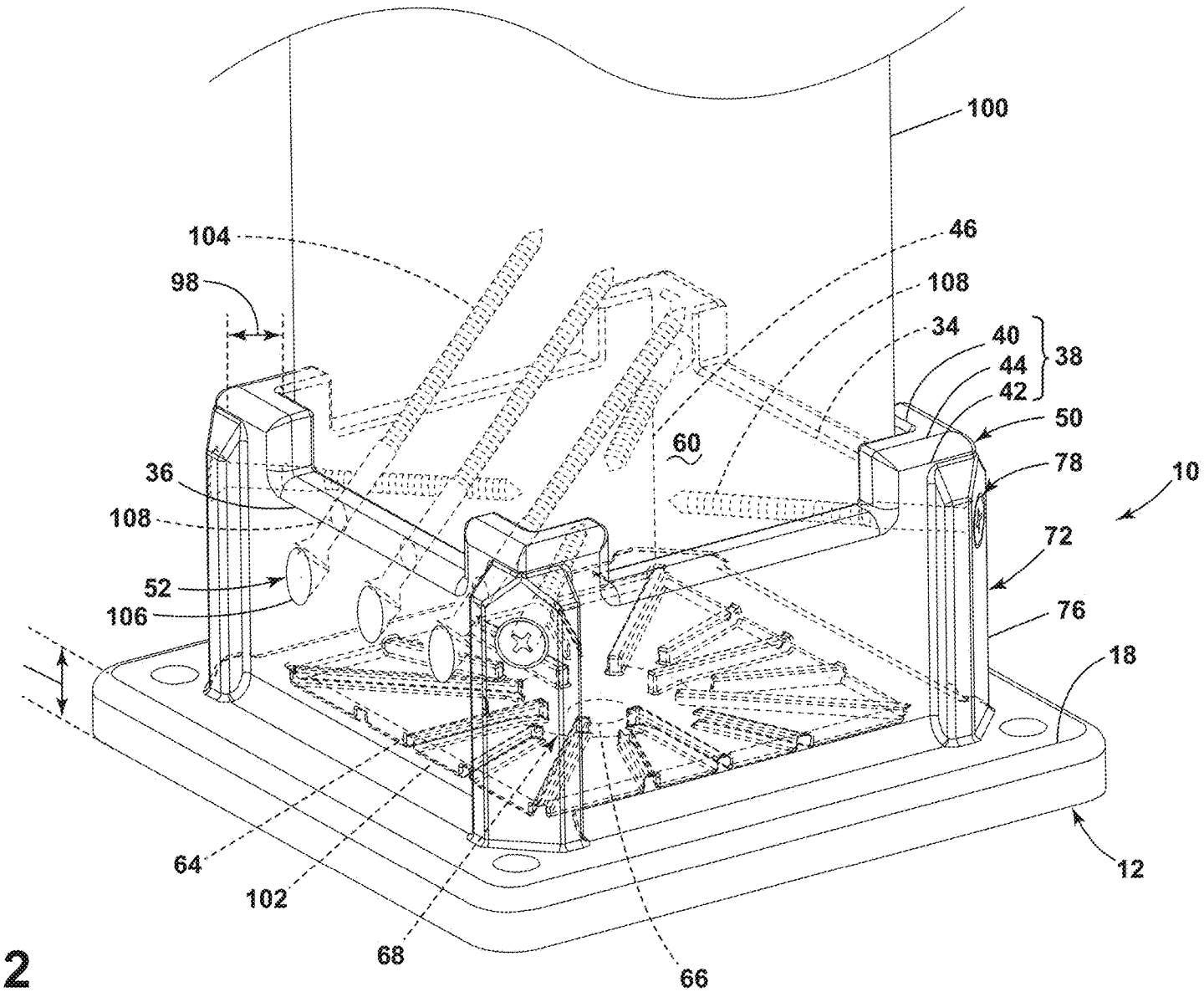
FIG. 2 is another perspective view of the post anchor of FIG. 1 with a post mounted thereto with fasteners.

FIG. 2 illustrates the post 100 located in the receiver 60 of the post anchor 10. The corners 46 and corner members 72 can act as a guide for insertion of the post 100 into the receiver 60. When mounted in the receiver 60, the post 100 can contact one or more of the ribs 64. The ribs 64 can prevent the post 100 from resting on the upper surface 18 of the base plate 12 as well as stiffen the base plate 12.

The post 100 can be made up of multiple materials and sizes that meet or exceed code regulations set forth in IBC or IRC. For example, the post 100 can be a treated 4×4 wooden post made of #2 Southern Yellow pine or better, having a width and a length of 3.5 inches (approximately 89 millimeters) and a height of 36 inches (approximately 915 millimeters). In another example, the post 100 can be a 4×4 wood post comprising of western red cedar, having a width and a length of 3.5 inches (approximately 89 millimeters) and height that is 42 inches (approximately 1067 millimeters). Further still in another non-limiting example the post 100 can be a 4×4 wooden post comprising of pressure-treated cedar tone, having a width and a length of 3.5 inches (approximately 89 millimeters) and a height of 48 inches (approximately 1219 millimeters).

A side thickness 98 can be measured from the interior surface 34 to the corresponding exterior surface 36 of the sides 30. The side thickness 98 can be of any thickness, which is needed to pass building code requirements such as IBC or IRC. While any thickness that meets building codes is considered, the sides 30 can have an approximate thickness of ⅝ of an inch (approximately 16 millimeters). While illustrated as having the same side thickness 98, it is contemplated that thickness of the sides 30 can vary from one side 30 to another or from one portion of the sides 30 to another. The inner shoulder 40 or the outer shoulder 42 of the top surface 38 can have a radius of curvature less than or equal to half of the side thickness 98.

A first set of fasteners 104 couple the post anchor 10 to the post 100. The first set of fasteners 104 can be, by way of non-limiting example, screws, bolts, washers gaskets, grommets, nuts, nails, rivets, or anchors. By way of further non-liming example, the first set of fasteners 104 can be screws, such as exterior construction screws. A first non-limiting example of a screw can include a #14×3.5 inches screw. Another non-limiting example of a screw can include an approximately 6.3 millimeter thread diameter, approximately 89 millimeters in length, screw. Yet another non-limiting example of a screw can include a 4 inch (approximately 102 millimeter) screw. Yet another non-limiting example of a screw can include any structural wood screws of predetermined strength and durability.

The set of side wall apertures 52 can be threaded or otherwise formed to receive or secure one or more portions of the first set of fasteners 104. The side wall apertures 52 can be of uniform cross section or diameter as the side wall apertures 52 extend from the exterior surface 36 to the interior surface 34. It is contemplated that the cross section or diameter can increase, decrease, or change shape as the side wall apertures 52 extend from the exterior surface 36 to the interior surface 34. It is further contemplated that the side wall apertures 52 can be angled as they pass through the at least one side of the sides 30. That is, the passage or through hole defined by the set of side wall apertures 52 can have an inlet 106 at the exterior surface 36 and an outlet 107 at the interior surface 34 that are not aligned. The number of the side wall apertures 52 provided in the collar 14 can depend on the desired length of the post 100 to be seated in the receiver 60 of the post anchor 10. Additionally, or alternatively, the number of the side wall apertures 52 provided in the collar 14 can depend on the height or location of structures coupled to the post 100, such as, but not limited to, a railing or guardrail.

The set of side wall apertures 52 are configured such that the first set of fasteners 104 can be inserted into the post 100 at an angle 110 (see FIG. 3) to the post 100 that is less than or equal to ninety degrees. It will be understood that the set of side wall apertures 52 can be oriented to provide the first set of fasteners 104 at any suitable angle including, but not limited to, a preferred range between and including thirty-five degrees to fifty-five degrees. In the illustrated example, the set of side wall apertures 52 provide each of the first set of fasteners 104 at the same angle within the post 100, wherein, by way of example, that angle is a forty-five-degree angle. The angled entry of the first set of fasteners 104 into the post 100 increases the number of threads engaged with wood fibers. Increased engagement with the wood fibers allows the load of the fence or rail supported by the post 100 to be evenly distributed between the post 100 and the post anchor 10. While illustrated as being mounted at the same angle 110, each of the set of fasteners 104 can be fastened to the post 100 at varying angles.

As further illustrated in FIG. 2, the corner members 72 located at the corners 46 defined by the abutting of the sides 30 can include the corner member apertures 78. A second set of fasteners 108 can couple the post anchor 10 to the post 100 via the corner member apertures 78. The second set of fasteners 108 can be, by way of non-limiting example, screws, bolts, washers, gaskets, grommets, nuts, nails, rivets, or anchors. By way of further non-liming example, the second set of fasteners 104 can be #12×2.5 inches exterior construction screws (approximately 5.5 millimeter thread diameter, approximately 63.5 millimeters in length). Alternatively, they can be 2.5 inch (approximately 63.5 millimeter) structural wood screws capable of replacing a ⅜ inch (approximately 9.5 millimeters) lag screw.

When the post 100 is mounted to the post anchor 10, a portion of the second set of fasteners 108 passes through the corner member apertures 78 to fasten the collar 14 or corner member 72 to the post 100. The second set of fasteners 108 are positioned or angled with respect to the post 100 such that the second set of fasteners 108 do not contact the first set of fasteners 104. By way of non-limiting example, the second set of fasteners 108 are illustrated as being inserted generally perpendicular to the post 100. By way of further non-limiting example, the second set of fasteners 108 are mounted generally perpendicular to the flat face 76 of the corner member 72.

A benefit of the inclusion of the top protrusion 50 is to make the sides 30 at the corners 46 higher. The increase in height adds structural integrity to strengthen the corners 46. Further, the increase in height at the corners allows the second set of fasteners 108 to be located farther away from the base plate 12, which deters splitting of the post 100.

Gaps 102 can be defined as a region bound by one or more portions of the ribs 64, the post 100, one or more portions of the interior surfaces 34, and a portion of the upper surface 18 of the base plate 12. That is, fluid that enters the receiver 60 can be directed to the opening 66 via at least the gaps 102. The gaps 102 can have a downward directed sloped shape at the upper surface 18. That is, the post anchor 10 can have a drainage system that includes one or more of the gaps 102, the ribs 64, the funnel 68, or the opening 66. Pulling fluid away from the post 100 can help maintain and extend the structural integrity of the post 100.

During installation, the post 100 can be inserted into the receiver 60 of the post anchor 10. The post 100 rests on ribs 64, adjacent to the upper surface 18 of the base plate 12. In some instances, one or more shims (not shown) can be inserted between the interior surface 34 of the sides 30 and the post 100. Once the desired angle of the post 100 in the post anchor 10 is obtained, the post 100 is fastened to the post anchor 10. The second set of fasteners 108 are inserted to the corner member apertures 78. By way of non-limiting example, the second set of fasteners 108 can be driven into the post 100. Optionally, the second set of fasteners 108 can be driven into pre-drilled holes in the post 100. The second set of fasteners 108 can be generally perpendicular to the post 100 or corner member 72, or generally parallel to the lower surface 16 of the base plate 12.

Next, the first set of fasteners 104 are inserted into the side wall apertures 52. By way of non-limiting example, the first set of fasteners 104 can be driven into the post 100. Optionally, the first set of fasteners 104 can be driven into pre-drilled holes in the post 100. The side wall apertures 52 can align the first set of fasteners 104 at a predetermined mounting angle 110 (sec FIG. 3) relative to the post 100.

Figure 3:
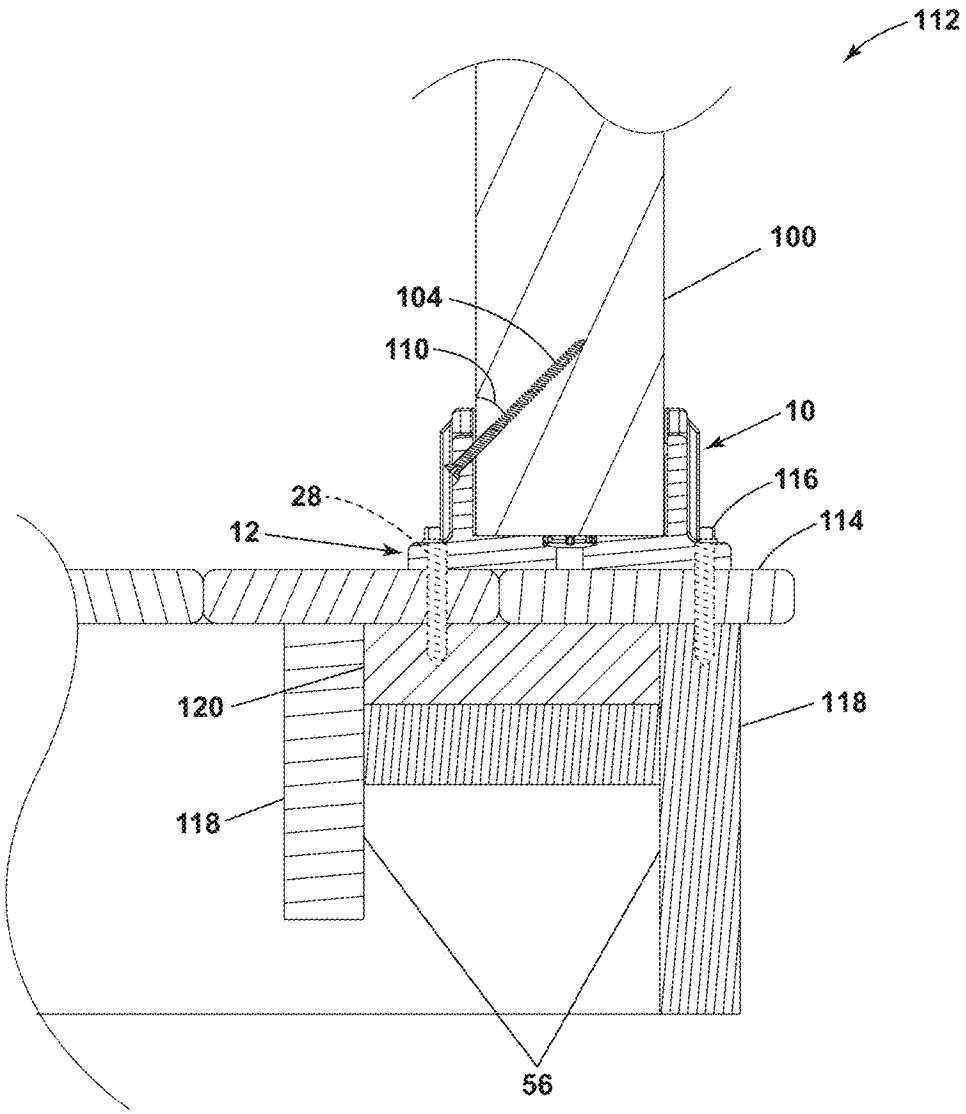
FIG. 3 is a cross-sectional view of the post anchor and post of FIG. 2 installed on a decking surface according to aspects of the present disclosure.

FIG. 3 is a cross-sectional view of the post anchor 10 within a post mounting system or a railing system 112, wherein the post anchor 10 secures the post 100 to a surface 114. The surface can be, by way of non-limiting example, concrete flooring, wood decking, composite decking, stone flooring, porcelain tiles or any other kind of indoor and outdoor flooring, decking, patio, platform, or slab.

FIG. 3 further illustrates the angle 110 at which the first set of fasteners 104 are positioned relative to the post 100. The side wall apertures 52, through which at least a portion of the first set of fasteners 104 pass, can align the first set of fasteners 104 at the desired angle 110 relative to the post 100. The angle 110 can be measured as the acute angle between an outside wall of the post 100 and at least one of the first set of fasteners 104.

A third set of fasteners 116 couples the post anchor 10 to the surface 114. The third set of fasteners 116 can be, by way of non-limiting example, screws, bolts, washers, gaskets, grommets, nuts, nails, rivets, or anchors. By way of further non-limiting example, the third set of fasteners 116 can be 5/16×4 inches (approximately 8 millimeters by 102 millimeters) lag screws or through-bolts. The third set of fasteners 116 are inserted into the base plate apertures 28 and extend into or through the surface 114. The length of the third set of fasteners 116 can be determined based on the surface 114 and structural requirements. For example, if the surface 114 is wood decking, as illustrated by way of non-limiting example, the third set of fasteners 116 are selected to extend into 3 inches (approximately 76 millimeters) of solid wood. Therefore, the post anchor 10 can be positioned on the surface 114 over at least one joist 118, so that at least a subset of the third set of fasteners 116 secure the post anchor 10 to the surface 114 and the joist 118 while extending into at least 3 inches (approximately 76 millimeters) of solid wood.

Wood blocking 120 can be added below the surface 114 between two or more joists 118, such that another subset of the third set of fasteners 116 secure the post anchor 10 to the surface 114 and the wood blocking 120 while extending into at least 3 inches (approximately 76 millimeters) of solid wood.

Figure 4:
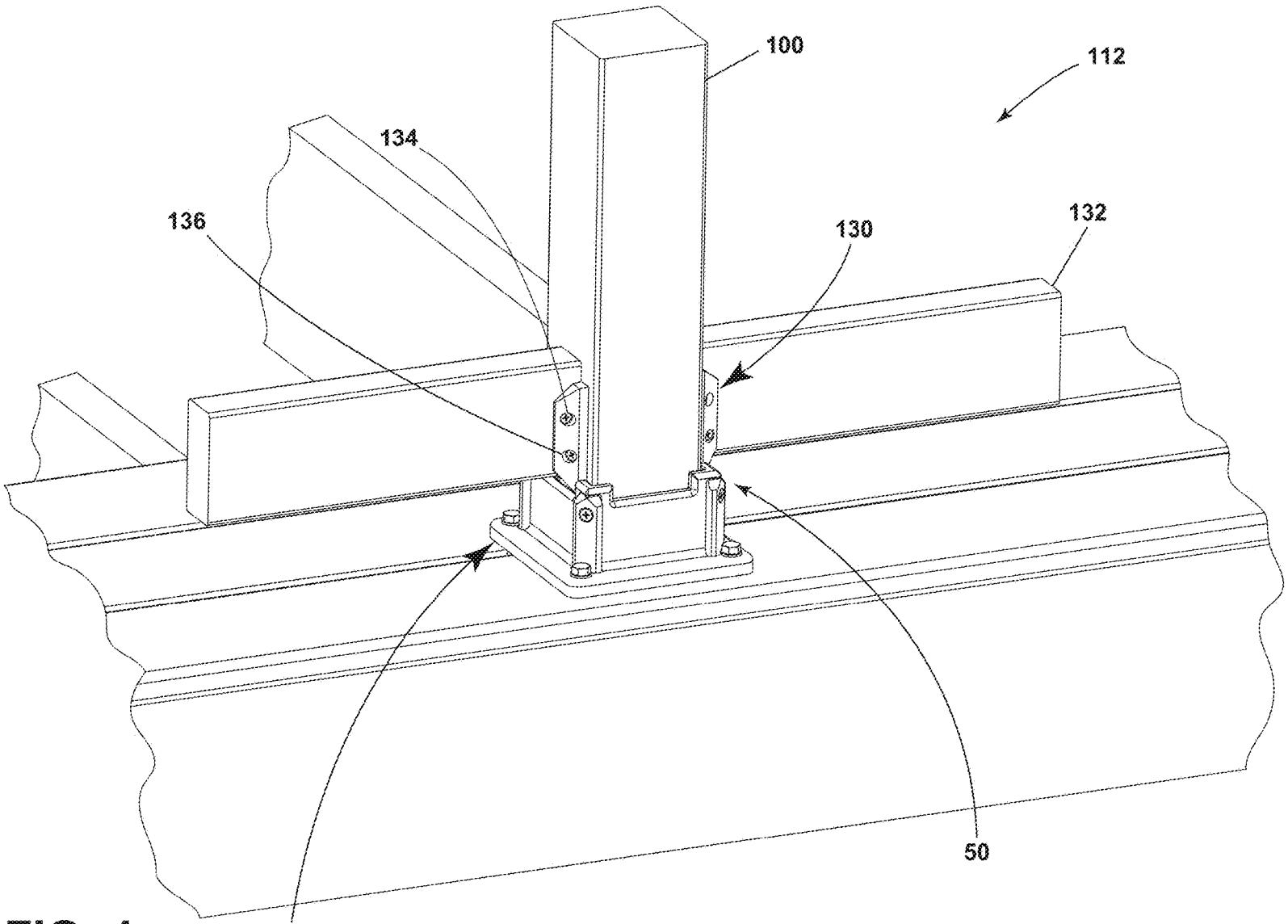
FIG. 4 is a perspective view of the installed post anchor of FIG. 3 with a railing mounted to the post.

FIG. 4 illustrates a perspective view of a fencing system, wherein the railing system 112 further includes brackets 130 and railing 132. The brackets 130 are illustrated as being positioned between a pair of top protrusions 50 and mechanically coupled to the railing 132 via a fourth set of fasteners 134. The fourth set of fasteners 134 can be, by way of non-limiting example, a screw, bolt, washer, gasket, grommet, nut, nail, rivet, or anchor. By way of further non-limiting example, the fourth set of fasteners 134 can be #8×1 inch (approximately 4.1 millimeters thread diameter, approximately 25.4 millimeters in length) screws which are used to couple the bracket 130 to the rail 132.

A fifth set of fasteners 136 couples the bracket 130 to the post 100. The fifth set of fasteners 136 can be, by way of non-limiting example, screws, bolts, washers, gaskets, grommets, nuts, nails, rivets, or anchors. By way of further non-limiting example, the fifth set of fasteners 136 can be #8×2 inches (approximately 4.1 millimeters thread diameter, approximately 51 millimeters in length) screws.

A recessed portion 138 can be located between the top protrusions 50. That is, portions of the sides 30 that do not include the top protrusions 50 can define the recessed portion 138. The brackets 130 and railing 132 are configured to fit together and be received by the recessed portion 138 between at least two of the top protrusions 50. When located between the at least two of the top protrusions 50, the railing 132 is positioned in relationship to the post 100 and post anchor 10. The positioning provided by the brackets 130 seated in the recessed portion 138 allows for the railing 132 to be properly located with little to no measurements.

It will be understood that while the remainder of this specification discusses the aspects of this disclosure with reference to a post anchor, a post, and a surface for use in a fence or railing application, the post anchor, post, and surface can have much broader applicability and provide similar benefits thereto.

Aspects of the present disclosure provide a variety of benefits including that the disclosed post anchor allows for fast and easy installation of posts. Further still, in a non-limiting example, the post anchor as described herein passes the 2018 International Residential Code which requires all posts and their attachments to any deck are able resist a design live point load of 200 pounds (approximately 91 kilograms) in any direction. It should be noted that a factor of safety of 2.5 must be applied to the 200-pound (approximately 91 kilograms) design live point load so during the tests, the post mount must resist a 500-pound (approximately 227 kilograms) point load minimum. The application of this 500-pound (approximately 227 kilograms) point load is measured 36 inches (approximately 914 millimeters) from the surface and is directed in a horizontal direction. With the increase from three to four fasteners in the first set of fasteners 104 (and corresponding side wall apertures 52), the post anchor 10 was successful in holding the application of the 500-pound (approximately 227 kilograms) point load at 42 inches (approximately 1067 millimeters) from the surface.

Figure 5:
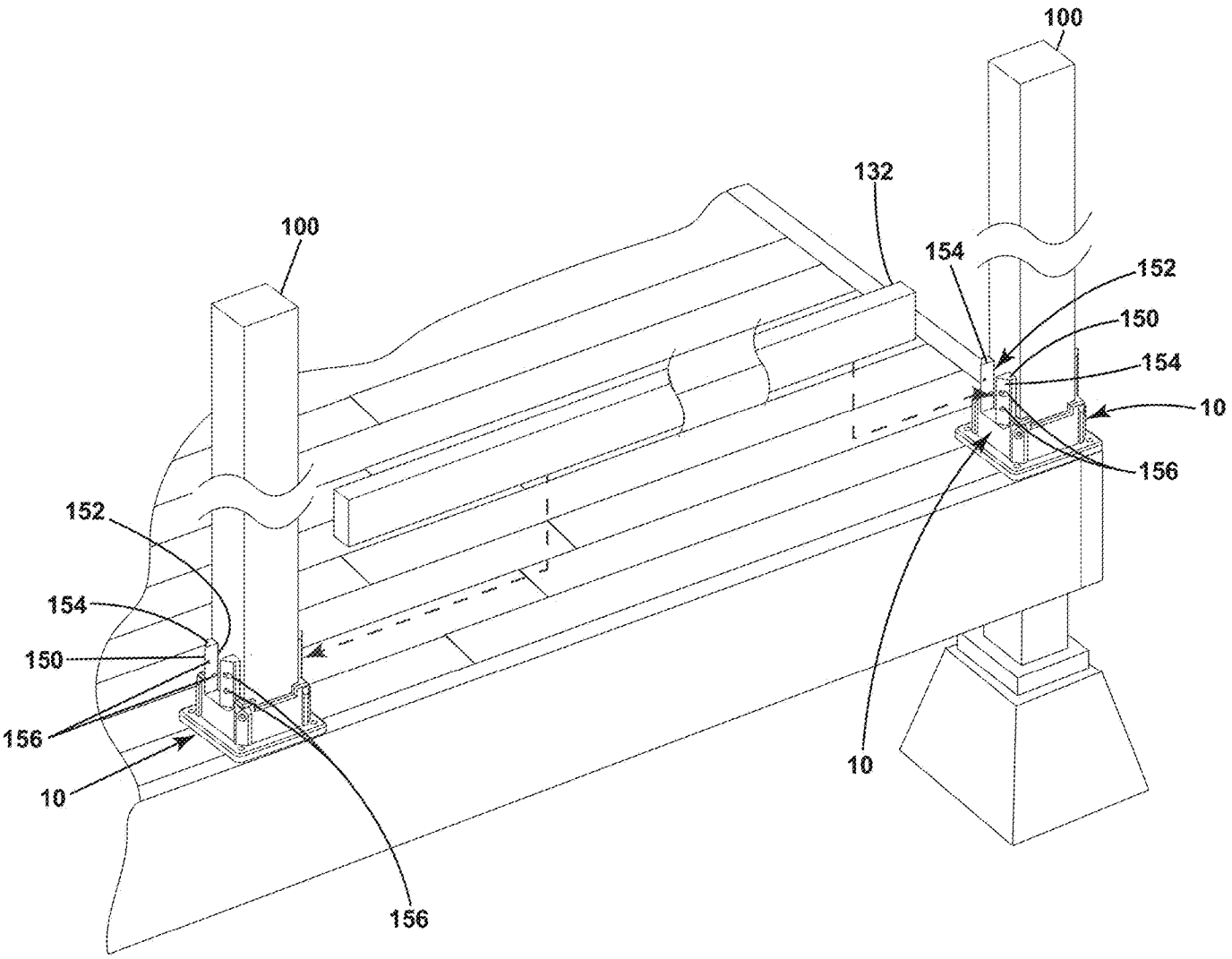
FIG. 5 is a perspective view of a second embodiment of the post anchor of FIG. 1, whereby the second embodiment has at least one integrated railing bracket thereon, wherein the second embodiment of the post anchor is shown provided at a base portion of a pair of deck posts with a bottom railing positioned therebetween.
Figure 6:
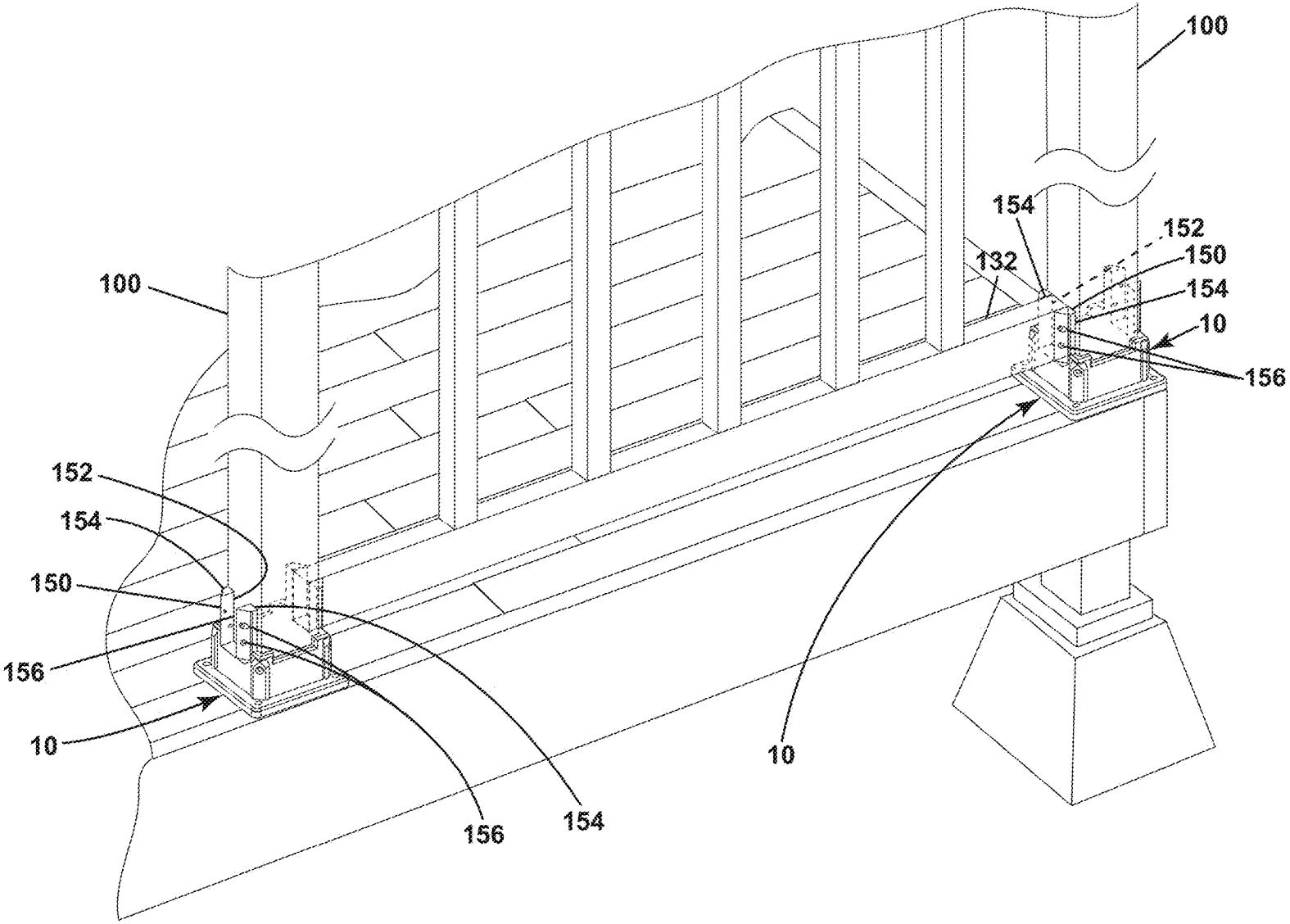
FIG. 6 a perspective view in a similar orientation to FIG. 5 wherein the bottom railing has been lowered into position between the pair of deck posts so that it extends between the pair of second embodiment post anchors having the integrated railing bracket thereon.

FIG. 5 illustrates an alternative embodiment of the post anchor 10 that includes an integrated railing bracket 150, that defines an opening 152 for receiving and supporting a portion of a railing member typically used for creating a railing extending from a post 100 supported by the post anchor 10. The integrated railing bracket 150 extends upwardly from the body of the post anchor 10 and the opening 152 is defined by a pair of legs 154 juxtaposed on either side of the opening 152. Each leg 154 contains a pair of diverging-angled apertures 156, the function of which would be apparent to one skilled in the art, including receiving toenail-angled fasteners therein for fastening the post anchor 10 to a portion of the railing member 132 received within the opening 152, as shown in FIG. 6, which shares common reference numerals with FIG. 5.

FIG. 5 of this alternative embodiment of the post anchor 10 is shown holding a post 100 received therein in a manner described with the previous description of the post anchor 10 of this specification. The illustration shown in FIG. 5 shows the illustrative railing member 132 extending between the pair of posts 100 received within a respective post anchor 10. It will also be understood, without departing from the scope of the invention, that the legs 154 defining the integrated railing bracket 150 can be integrally formed during manufacture with the post anchor 100 or separately formed and molded or welded to the post anchor 10 in a commonly-understood way to create an integral unit for the postcard and having the integrated railing bracket 150 thereon.

It will be understood that the railing member 132 can comprise any typical railing number normally and typically used on deck structures to serve as a bottom rail of a railing. Exemplary selections for the railing member 132 include, but are not limited to, nominal ground treated lumber, regular lumber, composite decking materials, and polymeric or other non-organic structural materials. Those skilled in the art will understand that any known product or material typically used for deck railing members can be used as the railing member 132 without departing from the scope of the invention.

The size of the opening 152 can be provided in a number of vertical and horizontal dimensions having a desired aspect ratio depending upon the dimensional nature of the railing member 132 to be received therein. For example, in the example shown in the embodiment of FIGS. 5-6, the opening 152 of the integrated railing bracket 150 preferably have an aspect ratio for receipt of a nominal 2×4 or 2×6 piece of ground treated lumber or other dimensionally stable member to serve as the railing member 132. It will be understood that the size of the legs 154 and their spacing from one another due to their juxtaposition on either side of the opening 152, can be selected to dimensionally and securely receive other sizes of railing members 132 having different cross-sectional lengths and widths. It would be understood by one skilled in the art how to change the size, width, and depth of the legs 154 defining the opening 152 in the integrated railing bracket 150 without departing from the scope of the invention.

Turning now to FIGS. 7-10, additional embodiments of the post anchor 10 having the integrated railing bracket 150 on at least one side thereof will now be described. It will be understood that each of the embodiments of the post anchor 10 having the integrated railing bracket 150 on at least one side thereof is shown in FIGS. 7-10 to provide different configurations of the post anchor 10 having the integrated railing bracket 150 to provide multiple options for creating railing configurations for a deck structure. FIGS. 7-10 are intended to illustrate different ways in which the post anchor 10 can be configured with the integrated railing bracket 150 to provide numerous options for continuing and/or changing or diverting the direction of railing in which the post anchor 10 supporting a post 100 can be used. It will be understood that each of the embodiments shown in FIGS. 7-10 need not be independently described and are referred to in the corresponding drawings with reference numerals common to the preceding drawings for common components thereof.

Figure 7:
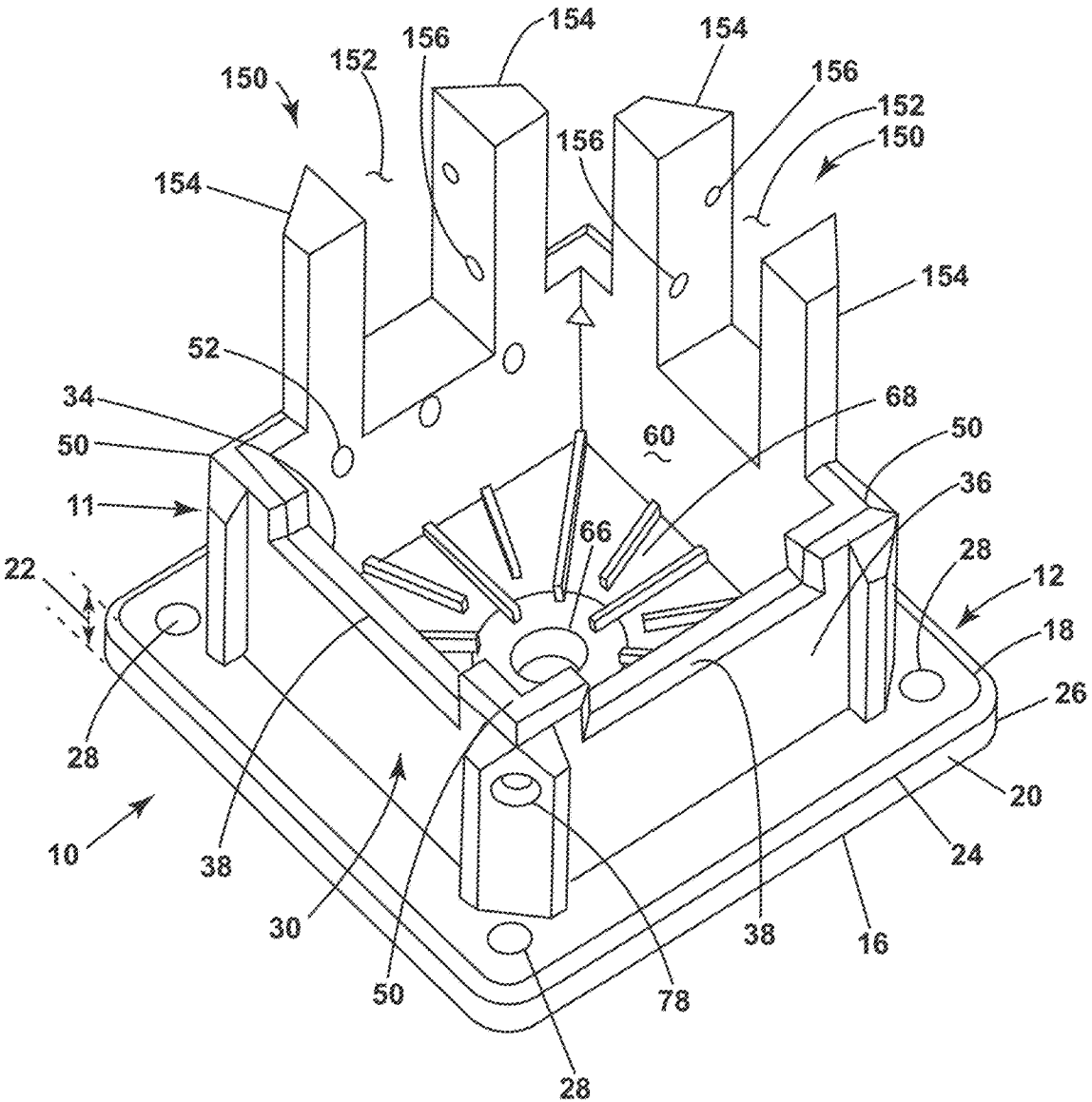
FIG. 7 is a perspective view of the second embodiment of the post anchor shown in FIGS. 5-6 wherein a pair of integrated railing brackets are provided on adjacent sides of the post anchor.
Figure 8:
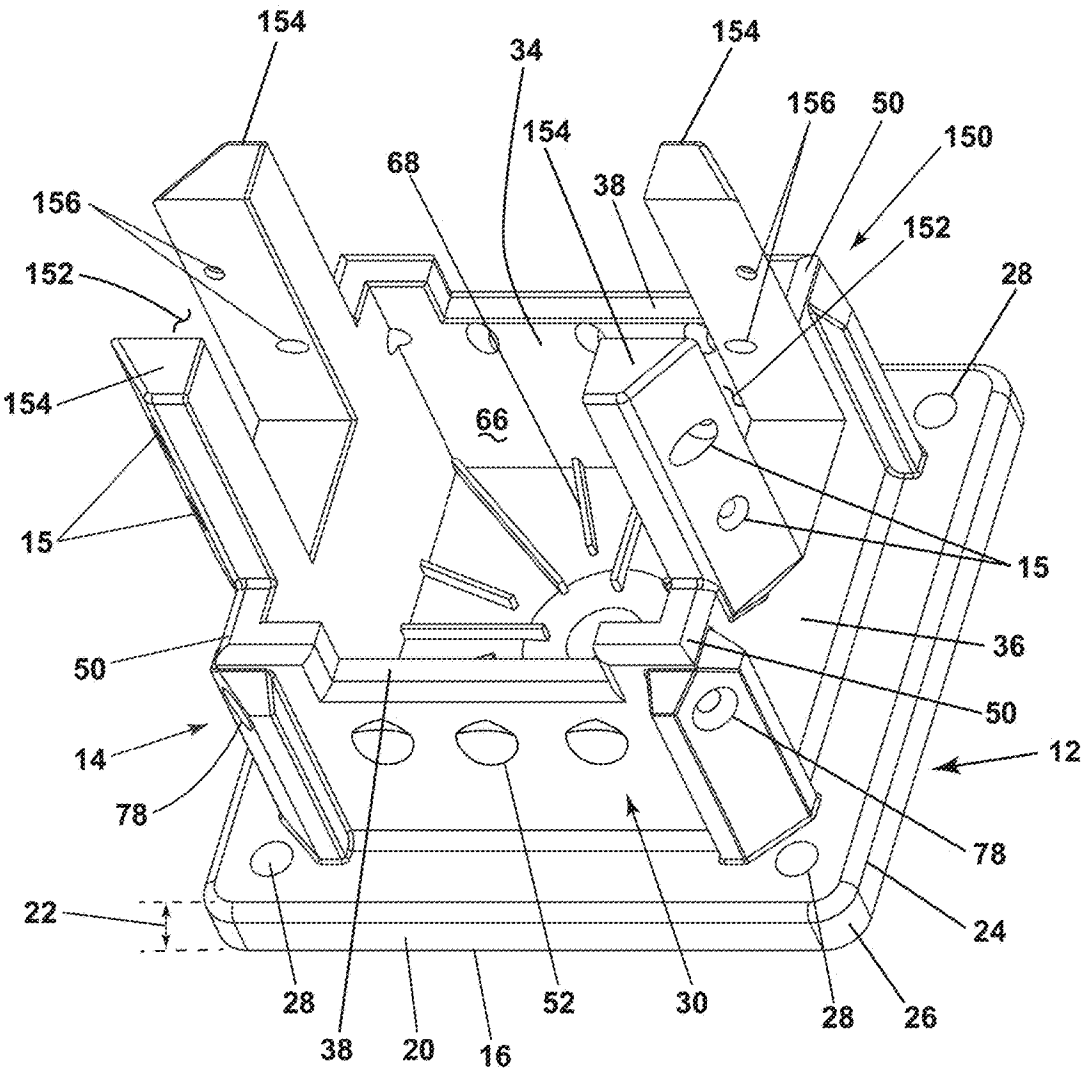
FIG. 8 is a perspective view of the second embodiment of the post anchor shown in FIGS. 5-6 wherein a pair of integrated railing brackets are provided on opposite sides of the post anchor.
Figure 9:
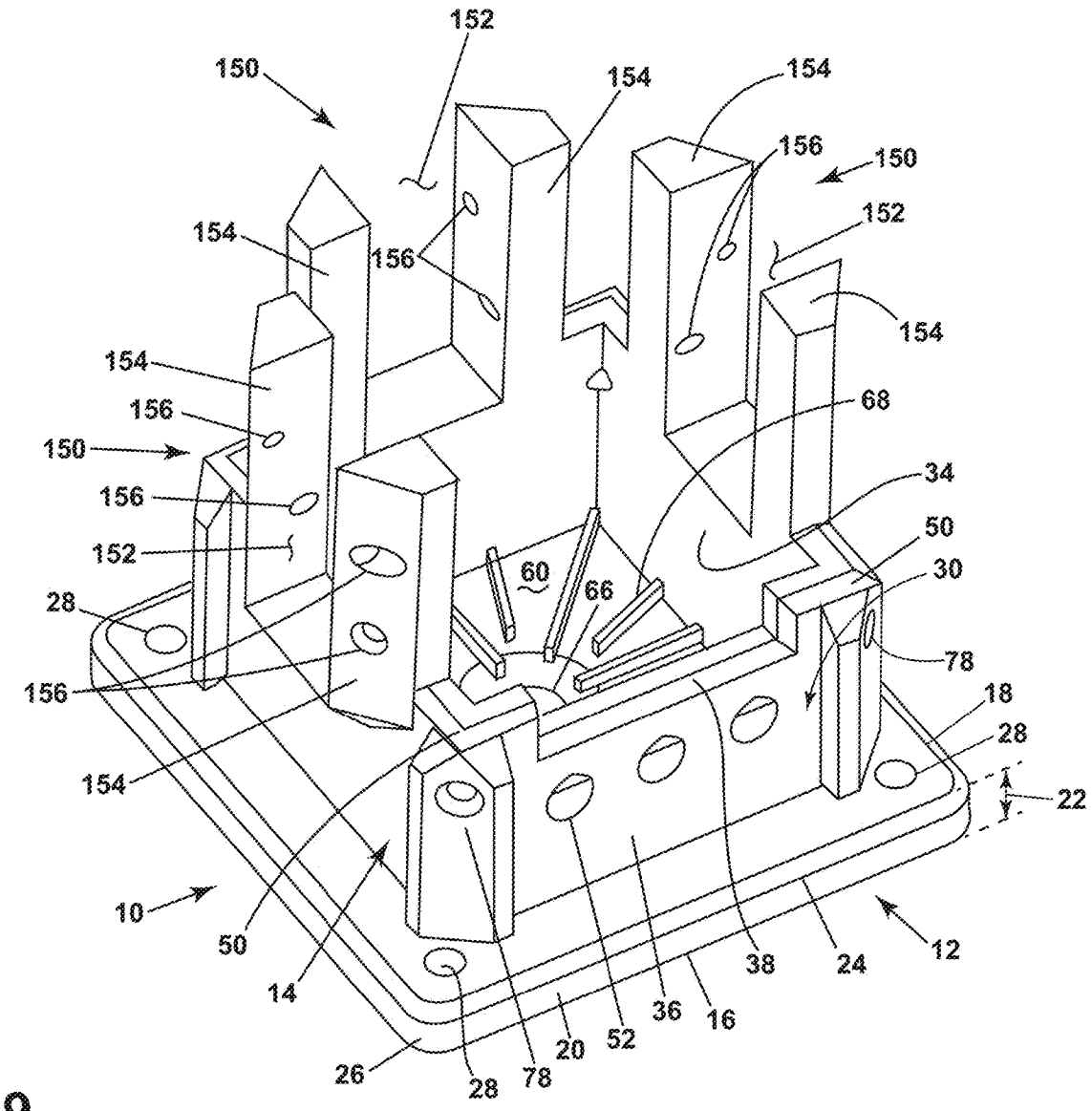
FIG. 9 is a perspective view of the second embodiment of the post anchor shown in FIGS. 5-6 wherein a pair of integrated railing brackets are provided on all but one side of the post anchor.
Figure 10:
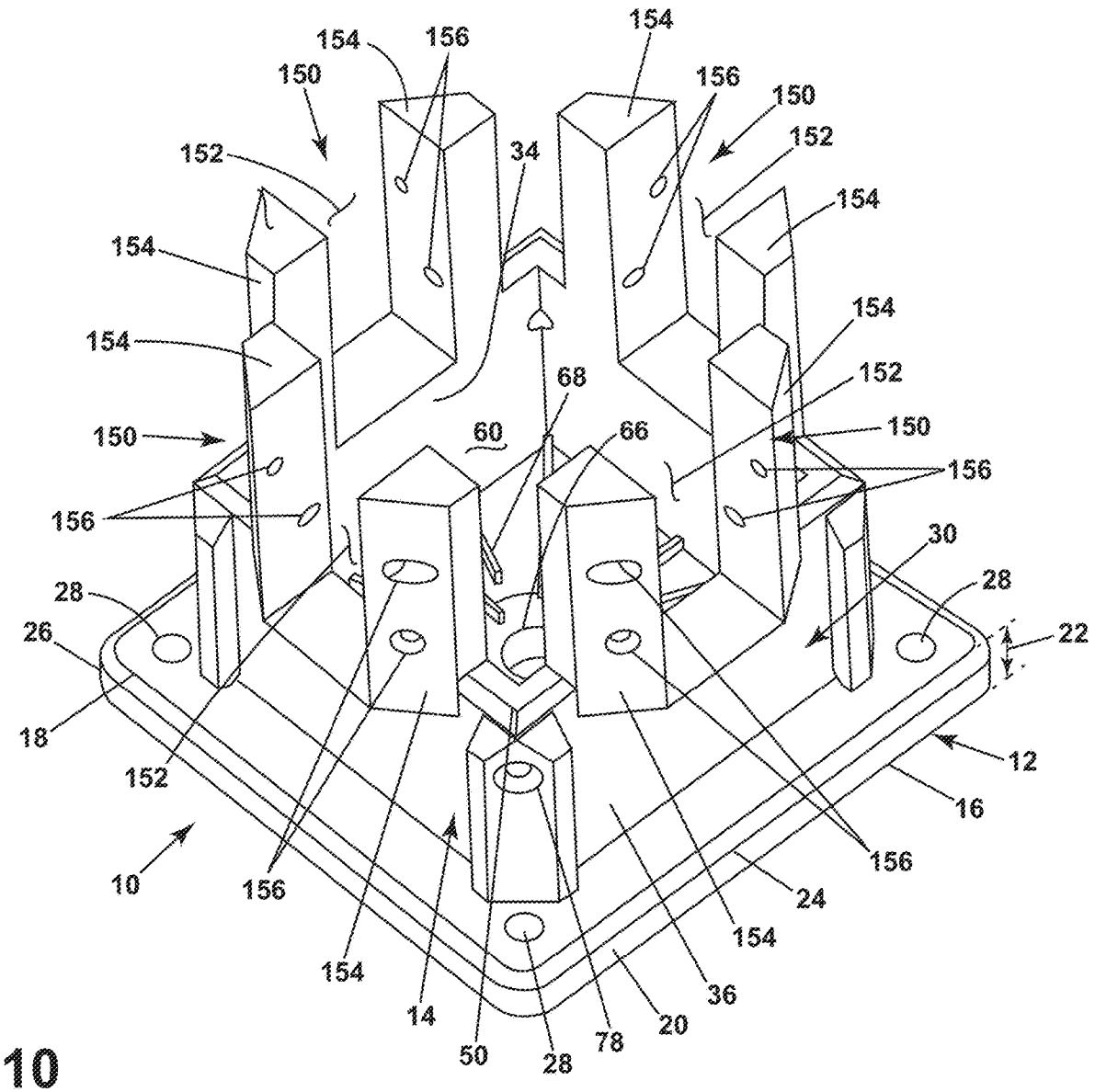
FIG. 10 is a perspective view of the second embodiment of the post anchor shown in FIGS. 5-6 wherein a pair of integrated railing brackets are provided on all sides of the post anchor.

In FIG. 7, an embodiment of the post anchor 10 is shown having an integrated railing bracket 150 (defined by the legs 154, opening 152 and apertures 156 as previously described) on a pair of adjacent sides of the post anchor 10. It will be understood that, while the post anchor 10 is shown having four sides for receipt of a typical piece of ground treated lumber, the post anchor 10 could be provided with three or more sides, without departing from the scope of the invention to provide a support for railing having a geometry differing from rectangular. Turning to FIG. 8, an embodiment of the post anchor 10 is shown having an integrated railing bracket 150 on opposite sides of the post anchor 10. Turning to FIG. 9, an embodiment of the post anchor 10 is shown in having an integrated railing bracket 150 on all but one side of the post anchor 10 to provide a t-junction for a railing member 132 supported by the integrated railing bracket 150. Turning to FIG. 10, an embodiment of the post anchor 10 is shown having an integrated railing bracket 150 on all sides of the post anchor 10 to provide an x- or +-junction for a railing 132 supported by the integrated railing bracket 150.

The combination of the materials used to make the post anchor and the specific location of the first and second set of fasteners allows the post anchor, as described, to meet building code requirements. The polyamide or other plastic reinforced by fiberglass provides the flexural strength of the post anchor. The post, via the first and second set of fasteners, is mounted in the post anchor in such a way that force and load are appropriately distributed. Fillets or corner members provide additional structural support and provide additional strength at junctions.

The fiber-reinforced nylon bracket or post anchor as disclosed herein provides a lightweight and more durable alternative to metal post anchors. The fiber-reinforced nylon post anchor as opposed to the metal post anchor can better withstand elements such as, but not limited to, humidity, elevated temperatures, and extended ultra-violet (UV) exposure.

The angled entry of the first set of fasteners increases the contact between fastener threads and the post. The increase in contact better distributes and more securely attaches the post and the post anchor.

Railings can be easily mounted to the posts, as brackets coupled to the railings properly locate the railing relative to the post and post anchor. The top protrusions that extend from each of the sides at the corners strengthens the corner, seats the bracket and railing, and allows the second set of fasteners to be located farther from the base plate. Locating the second set of fasteners farther from the base plate reduces or eliminates splintering.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which is defined in the appended claims. Hence, specific dimensions and other physical characteristics relating to the embodiments disclosed herein are not to be considered as limiting, unless the claims expressly state otherwise.

Further aspects of the disclosure are provided by the subject matter of the following clauses:

A post anchor comprising a base plate having an upper surface and a lower surface, the base plate defining a set of apertures extending through the base plate from the lower surface to the upper surface, and a collar that extends from the upper surface of the base plate, the collar comprising a set of sides having an interior surface and an exterior surface, each of the set of sides abutting another of the set of sides at corners, wherein at least one of the set of sides includes a set of side wall apertures, and a set of corner members located at the corners, wherein each of the set of corner members includes a corner member aperture that extends from a corner exterior to the interior surface.

The post anchor of clause 1 wherein the post anchor comprises a polyamide or nylon and fiberglass.

The post anchor of any preceding clause wherein the post anchor comprises nylon 66.

The post anchor of any preceding clause wherein the base plate and the collar unitarily formed by injection molding.

The post anchor of any preceding clause wherein the set of sides and a portion of the upper surface define a receiver.

The post anchor of any preceding clause wherein the upper surface of the base plate within the receiver includes ribs.

The post anchor of any preceding clause, further comprising an opening in the upper surface of the base plate within the interior.

The post anchor of any preceding clause, further comprising a funnel circumscribing the opening.

The post anchor of any preceding clause where in the funnel includes a radially outer edge and the thickness of the base plate decreases from the radially outer edge to the opening.

The post anchor of any preceding clause wherein the set of corner members include a set of flared protrusions.

The post anchor of any preceding clause wherein the set of sides include top protrusions at the corners.

The post anchor of any preceding clause, further comprising a fillet at the intersection of the collar and the base plate.

The post anchor of any preceding clause wherein an upper surface of at least one of the set of sides comprises a recessed portion railing bracket defined by a pair of sides extending upwardly from the collar and juxtaposed from one another to define an opening therebetween extending downwardly from the upper surface thereof and between respective corner members thereof to define a resting surface capable of receiving a portion of a railing.

The post anchor of any preceding clause wherein the portion of the railing can be located within the recessed portion opening of the upper surface of the at least one set of railing brackets to facilitate mounting of the railing to at least one of a post located within the collar of the post anchor or the post anchor itself.

A post mounting system comprising a post, and a post anchor coupled to the post, the post anchor comprising a base plate having an upper surface and a lower surface, the base plate defining a set of apertures extending through the base plate from the lower surface to the upper surface, and a collar that extends from the upper surface of the base plate, the collar comprising a set of sides having an interior surface and an exterior surface, each of the set of sides abutting another of the set of sides at corners, wherein the interior surface of the set of sides defines an interior that receives at least a portion of the post, a set of side wall apertures extending through at least one side of the set of sides, a first set of fasteners that couple the collar to the post through the set of side wall apertures, a set of corner members located at the abutting of each of the set of sides, wherein the set of corner members include a set of corner member apertures extending from a corner exterior to the interior surface, and a second set of fasteners that couple the post anchor to the post through the set of corner member apertures.

The post mounting system of any preceding clause wherein the post anchor comprises a polyamide or nylon and fiberglass.

The post mounting system of any preceding clause wherein the post anchor further comprises a drainage system.

A post anchor comprising a base plate having an upper surface and a lower surface, the base plate defining a set of base plate apertures extending through the base plate from the lower surface to the upper surface, and a collar that extends from the upper surface of the base plate, the collar comprising a set of sides extending from the upper surface and having an interior surface and an exterior surface, wherein each of the set of sides abut at corners to define an interior cavity that receives at least a portion of the post, a set of side wall apertures extending through at least one side of the set of sides, a first set of fasteners that couple the collar to the post through the set of side wall apertures, a set of corner members located at the corners, wherein each of the set of corner members include a set of corner member apertures extending from a corner exterior to the interior surface, a second set of fasteners that pass through the set of corner member apertures and couple the post anchor to the post, and top protrusions extending from the set of sides at or adjacent the corners, and at least one bracket is positioned between at least two of the top protrusions.

The post anchor of any preceding clause wherein the post anchor comprises a polyamide or nylon and fiberglass.

The post anchor of any preceding clause wherein the post anchor is couplable to a post and the at least one bracket couples a railing to the post.

The post anchor of any preceding clause, further comprising a drainage system.

The post anchor of any preceding clause, further comprising a fillet at the intersection of the collar and the base plate.

A fencing system comprising a post, a post anchor coupled to the post, the post anchor comprising a base plate having an upper surface and a lower surface, the base plate defining a set of base plate apertures extending through the base plate from the lower surface to the upper surface, and a collar that extends from the upper surface of the base plate, the collar comprising a set of sides extending from the upper surface and having an interior surface and an exterior surface, wherein each of the set of sides abut at corners to define an interior cavity that receives at least a portion of the post, a set of side wall apertures extending through at least one side of the set of sides, a first set of fasteners that couple the collar to the post through the set of side wall apertures, a set of corner members located at the corners, wherein each of the set of corner members include a set of corner member apertures extending from a corner exterior to the interior surface, a second set of fasteners that pass through the set of corner member apertures and couple the post anchor to the post, and top protrusions extending from the set of sides at or adjacent the corners, and a railing coupled to the post by brackets, wherein the brackets are positioned between at least two of the top protrusions when the railing is coupled to the post.

The fencing system of any preceding clause wherein the post anchor comprises a polyamide or nylon and fiberglass.

The fencing system of any preceding clause wherein the base plate and the collar of the post anchor are unitarily formed.

The fencing system of any preceding clause wherein the post anchor further comprises a drainage system.

The fencing system of any preceding clause wherein the post anchor further comprises a fillet at the intersection of the collar and the base plate.

The fencing system of any preceding clause wherein an upper surface of at least one of the set of sides comprises a recessed portion railing bracket defined by a pair of sides extending upwardly from the collar and juxtaposed from one another to define an opening therebetween extending downwardly from the upper surface thereof and between respective corner members thereof to define a resting surface capable of receiving a portion of a railing.

The fencing system of any preceding clause wherein the portion of the railing can be located within the recessed portion opening of the upper surface of the at least one set of railing brackets to facilitate mounting of the railing to at least one of a post located within the collar of the post anchor or the post anchor itself.

What is claimed is:

1. A post anchor comprising:

a base plate having an upper surface and a lower surface, the base plate defining a set of apertures extending through the base plate from the lower surface to the upper surface; and a collar that extends from the upper surface of the base plate, the collar comprising:

a set of sides having an interior surface and an exterior surface, each of the set of sides abutting another of the set of sides at corners, wherein at least one of the set of sides includes a set of side wall apertures; and a set of corner members located at the corners, wherein each of the set of corner members includes a corner member aperture that extends from a corner exterior to the interior surface;

wherein an upper surface of at least one of the set of sides comprises a railing bracket defined by a pair of sides extending upwardly from the collar and juxtaposed from one another to define an opening therebetween capable of receiving a portion of a railing; and whereby the portion of the railing can be located within the opening of the railing bracket to facilitate mounting of the railing to at least one of a post located within the collar of the post anchor or the post anchor itself.

2. The post anchor of claim 1 wherein the railing bracket includes legs, wherein the legs on the railing bracket are provided with at least two apertures for receipt of fasteners therein.

3. The post anchor of claim 2 wherein the at least two apertures on the legs of the railing bracket have non-parallel arrangement for toenailing a railing member to the post anchor.

4. The post anchor of claim 1 wherein the railing bracket is provided on at least two sides of the post anchor.

5. The post anchor of claim 4 wherein the railing bracket is provided on a pair of opposite sides of the post anchor.

6. The post anchor of claim 4 wherein the railing bracket is provided on a pair of adjacent sides of the post anchor.

7. The post anchor of claim 1 wherein the railing bracket is provided on at least three sides of the post anchor.

8. The post anchor of claim 1 wherein the railing bracket is provided on all but one side of the post anchor.

9. The post anchor of claim 1 wherein the railing bracket is provided on all sides of the post anchor.

10. A post mounting system comprising:

a post; and a post anchor coupled to the post, the post anchor comprising:

a base plate having an upper surface and a lower surface, the base plate defining a set of apertures extending through the base plate from the lower surface to the upper surface; and a collar that extends from the upper surface of the base plate, the collar comprising:

a set of sides having an interior surface and an exterior surface, each of the set of sides abutting another of the set of sides at corners, wherein the interior surface of the set of sides defines an interior that receives at least a portion of the post;

a set of side wall apertures extending through at least one side of the set of sides;

a first set of fasteners that couple the collar to the post through the set of side wall apertures;

a set of corner members located at the abutting of each of the set of sides, wherein the set of corner members include a set of corner member apertures extending from a corner exterior to the interior surface; and a second set of fasteners that couple the post anchor to the post through the set of corner member apertures;

wherein an upper surface of at least one of the set of sides comprises a railing bracket defined by a pair of sides extending upwardly from the collar and juxtaposed from one another to define an opening therebetween capable of receiving a portion of a railing; and whereby the portion of the railing can be located within the opening of the railing bracket to facilitate mounting of the railing to at least one of a post located within the collar of the post anchor or the post anchor itself.

11. The post anchor of claim 10 wherein the railing bracket includes legs, wherein the legs on the railing bracket are provided with at least two apertures for receipt of fasteners therein.

12. The post anchor of claim 11 wherein the at least two apertures on the legs of the railing bracket have non-parallel arrangement for toenailing a railing member to the post anchor.

13. The post anchor of claim 10 wherein the railing bracket is provided on at least two sides of the post anchor.

14. The post anchor of claim 13 wherein the railing bracket is provided on a pair of opposite sides of the post anchor.

15. The post anchor of claim 13 wherein the railing bracket is provided on a pair of adjacent sides of the post anchor.

16. The post anchor of claim 10 wherein the railing bracket is provided on at least three sides of the post anchor.

17. The post anchor of claim 10 wherein the railing bracket is provided on all but one side of the post anchor.

18. The post anchor of claim 10 wherein the railing bracket is provided on all sides of the post anchor.

* * * * *